US011855385B2

(12) United States Patent
Simonson

(10) Patent No.: US 11,855,385 B2
(45) Date of Patent: Dec. 26, 2023

(54) ELECTRICAL CORD PLUG ASSEMBLY

(71) Applicant: John Simonson, Boise, ID (US)

(72) Inventor: John Simonson, Boise, ID (US)

( * ) Notice: Subject to any disclaimer, the term of this patent is extended or adjusted under 35 U.S.C. 154(b) by 30 days.

(21) Appl. No.: 17/690,213

(22) Filed: Mar. 9, 2022

(65) Prior Publication Data

US 2023/0291142 A1 Sep. 14, 2023

(51) Int. Cl.
*H01R 13/58* (2006.01)

(52) U.S. Cl.
CPC ..... *H01R 13/58* (2013.01)

(58) Field of Classification Search
CPC ..... H01R 24/28; H01R 13/518; H01R 13/58
See application file for complete search history.

(56) References Cited

U.S. PATENT DOCUMENTS 2,027,447 A 1/1936 Percy
2,759,160 A 8/1956 Kelley
4,618,200 A 10/1986 Roberts
4,840,577 A * 6/1989 Prouty ..... H01R 13/6395 439/373
4,954,940 A * 9/1990 Chandler ..... H01F 27/02 439/409
D394,242 S * 5/1998 Park ..... D13/146
6,769,930 B1 8/2004 McDevitt, Jr.
6,921,281 B2 * 7/2005 Chen ..... H01R 13/5825 439/906
7,078,624 B1 7/2006 Stewart
D585,378 S 1/2009 Haber
D867,294 S 11/2019 Kusano

FOREIGN PATENT DOCUMENTS

WO WO2010111045 9/2010

* cited by examiner

*Primary Examiner* — Briggitte R. Hammond

(57) ABSTRACT

An electrical cord plug assembly for inhibiting a male electrical plug from being damaged includes a male electrical plug that is electrically coupled to an electrical cord. The male electrical plug can be plugged into a female electrical outlet. The male electrical plug has a pair of wings each extending laterally away from the male electrical plug. Each of the wings abuts a wall plate of the female electrical plug when the male electrical plug is plugged into the female electrical plug. Additionally, each of the wings extends in opposite directions from each other on the male electrical plug. In this way the wings inhibit the male electrical plug from being bent sideways in the female electrical plug.

7 Claims, 5 Drawing Sheets

ELECTRICAL CORD PLUG ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to electrical plug devices and more particularly pertains to a new electrical plug device for inhibiting a male electrical plug from being damaged. The device includes a male electrical plug which has a pair of wings extending laterally away in opposite directions from each other. The wings abut a face plate of a female electrical outlet when the male electrical plug is plugged into the female electrical outlet. In this way the wings inhibit the male electrical plug from tipping sideways and subsequently damaging contacts on the male electrical plug.

(2) Description of Related Art including information disclosed under 37 CFR 1.97 and 1.98

The prior art relates to electrical plug devices including a male electrical plug comprising a disk and a power cord extending laterally away from the disk. The prior art discloses an electrical plug protector that comprises a ring being positionable around a male electrical plug. The prior art discloses a protective housing that is positionable over a wall plate to restrain a pair of electrical plugs that are plugged into the wall plate. The prior art discloses a child safety yoke that comprises a central member with a hole for insertably receiving a power cord of an electrical plug and a pair of arms extending along opposing sides of the electrical plug. The prior art discloses an ornamental design of an electrical plug that includes a recess in a top side of an electrical plug.

BRIEF SUMMARY OF THE INVENTION

An embodiment of the disclosure meets the needs presented above by generally comprising a male electrical plug that is electrically coupled to an electrical cord. The male electrical plug can be plugged into a female electrical outlet. The male electrical plug has a pair of wings each extending laterally away from the male electrical plug. Each of the wings abuts a wall plate of the female electrical plug when the male electrical plug is plugged into the female electrical plug. Additionally, each of the wings extends in opposite directions from each other on the male electrical plug. In this way the wings inhibit the male electrical plug from being bent sideways in the female electrical plug.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
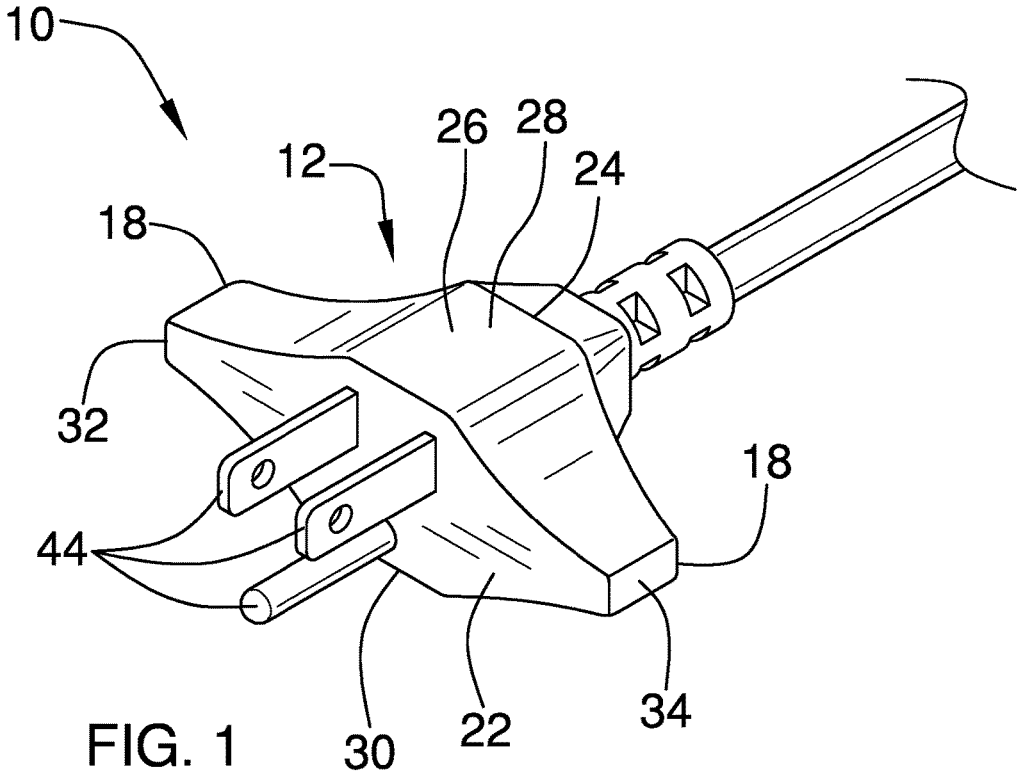
FIG. 1 is a front perspective view of an electrical cord plug assembly according to an embodiment of the disclosure.
Figure 2:
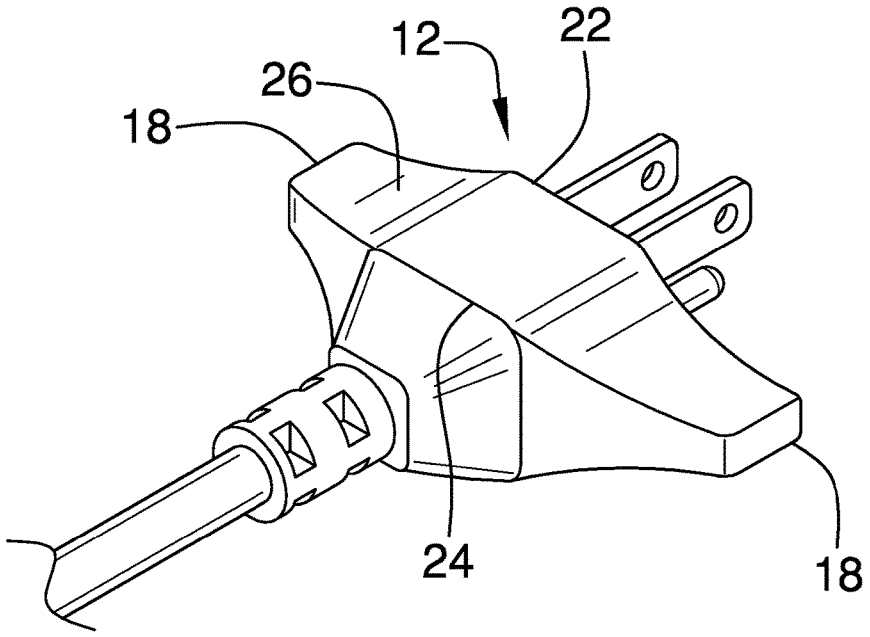
FIG. 2 is a back perspective view of an embodiment of the disclosure.
Figure 3:
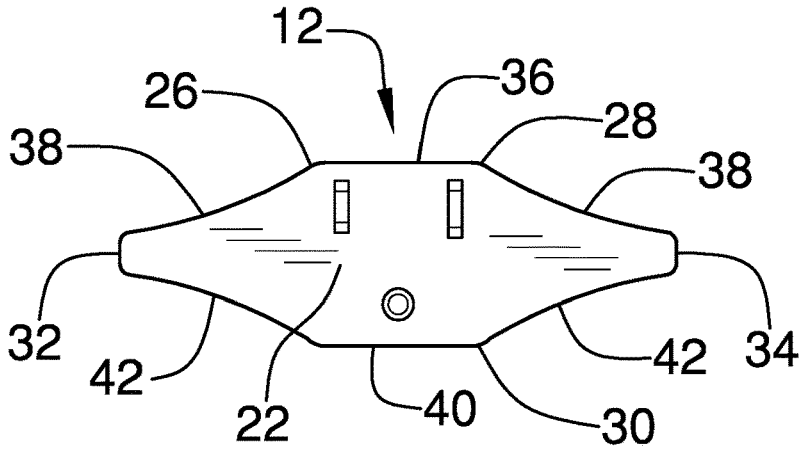
FIG. 3 is a front view of an embodiment of the disclosure.
Figure 4:
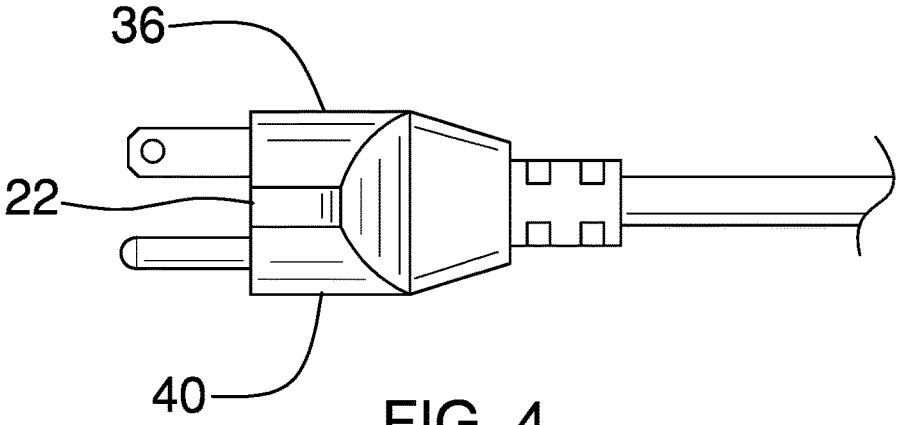
FIG. 4 is a left side view of an embodiment of the disclosure.
Figure 5:
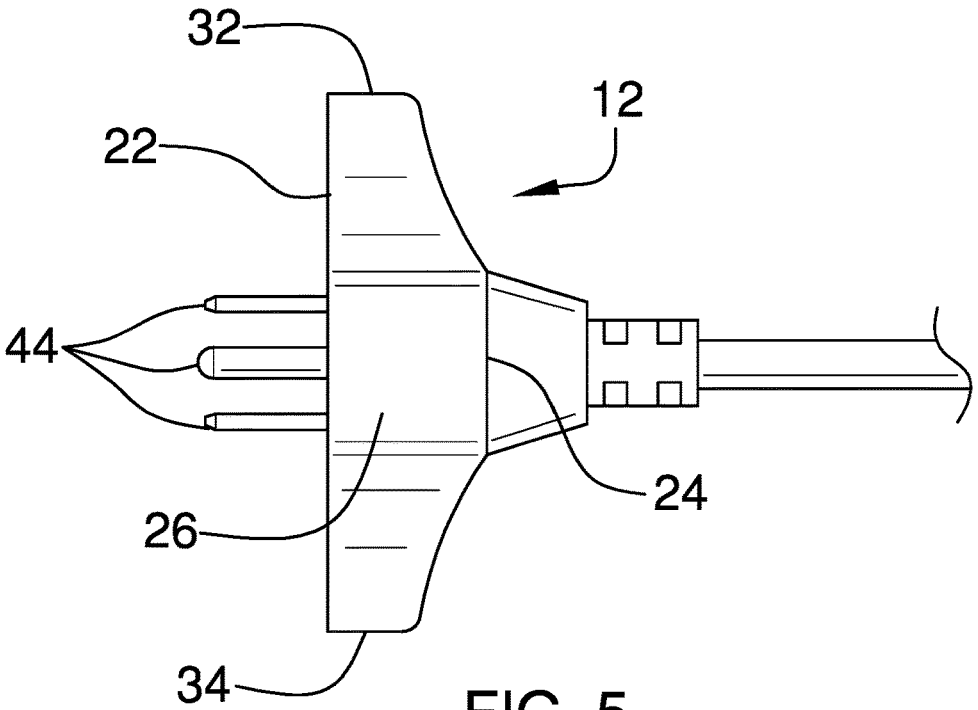
FIG. 5 is a top view of an embodiment of the disclosure.
Figure 6:
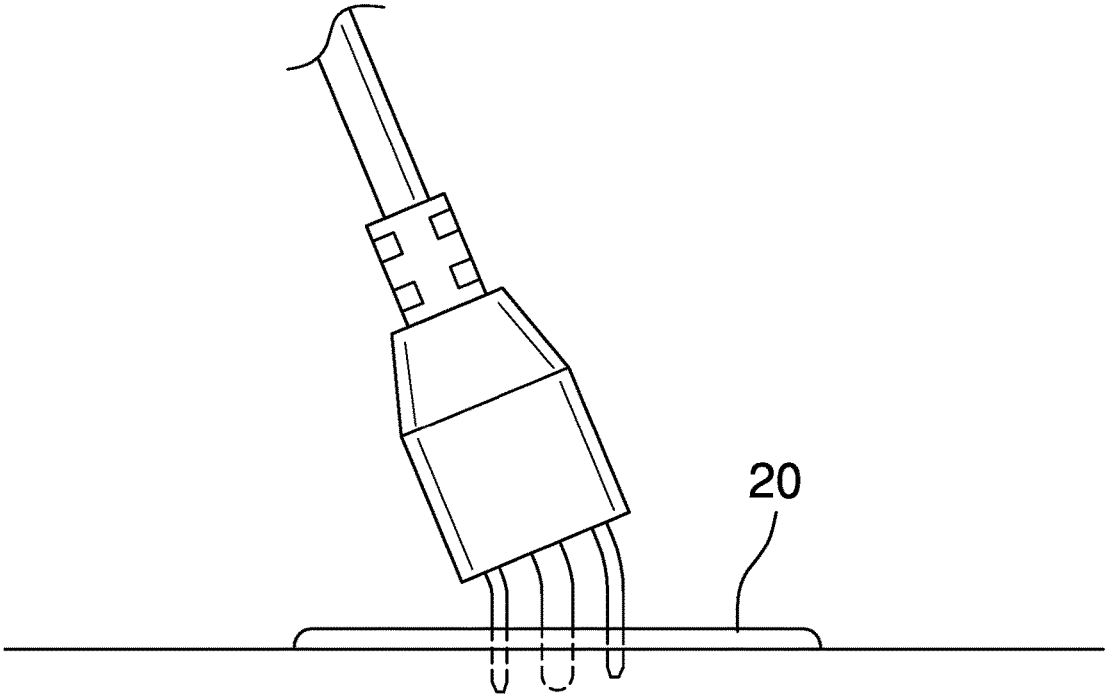
FIG. 6 is a perspective in-use view of an embodiment of the disclosure showing a traditional male electrical plug being damaged.
Figure 7:
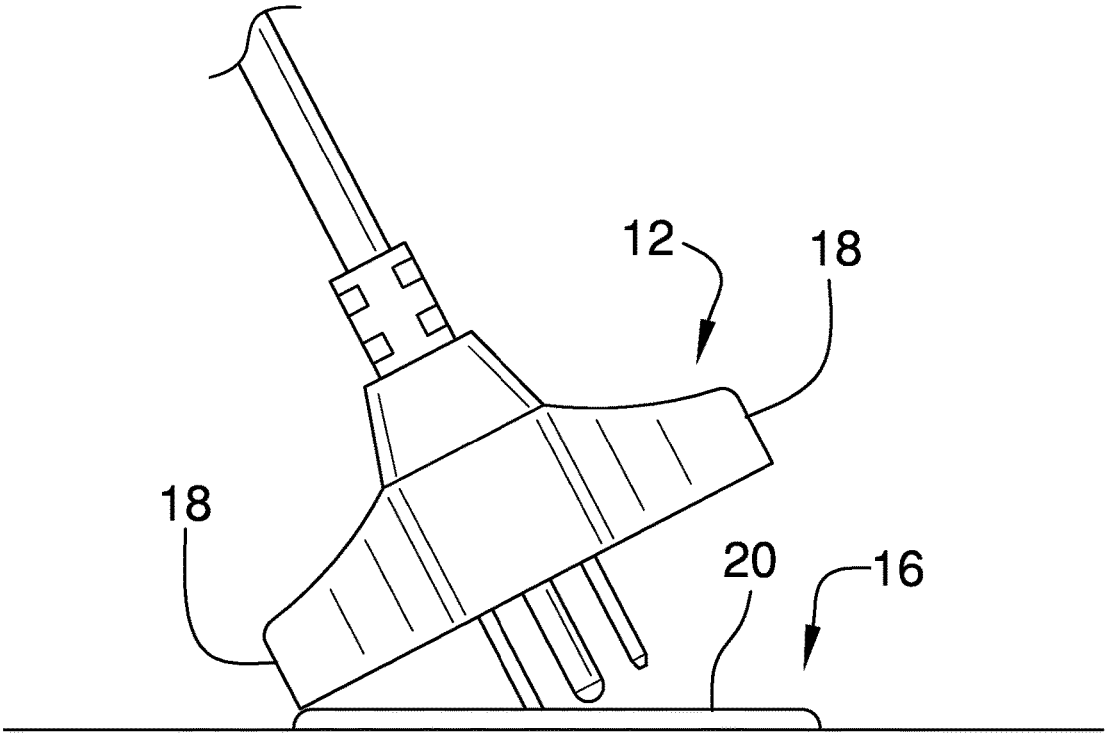
FIG. 7 is a perspective in-use view of an embodiment of the disclosure.

With reference now to the drawings, and in particular to FIGS. 1 through 9 thereof, a new electrical plug device embodying the principles and concepts of an embodiment of the disclosure and generally designated by the reference numeral 10 will be described.

As best illustrated in FIGS. 1 through 9, the electrical cord plug assembly 10 generally comprises a male electrical plug 12 that is electrically coupled to an electrical cord 14. The male electrical plug 12 can be plugged into a female electrical outlet 16. The male electrical plug 12 has a pair of wings 18 each extending laterally away from the male electrical plug 12. Each of the wings 18 abuts a wall plate 20 of the female electrical plug 12 when the male electrical plug 12 is plugged into the female electrical plug 12. Furthermore, each of the wings 18 extends in opposite directions from each other on the male electrical plug 12 to inhibit the male electrical plug 12 from being bent sideways in the female electrical plug 12. The electrical cord 14 may be an extension cord, a power cord for an electronic device or any other type of electrical cord.

The male electrical plug 12 has a front end 22, a back end 24 and an outer wall 26 extending between the front end 22 and the back end 24. The outer wall 26 has a top side 28, a bottom side 30, a first lateral side 32 and a second lateral side 34. Additionally, the male electrical plug 12 is elongated between the first lateral side 32 and the second lateral side 34 such that each of the first lateral side 32 and the second lateral side 34 defines an end of a respective one of the wings 18. The top side 28 has a first central portion 36 extending between pair of first curved portions 38.

Each of the first curved portions 38 curves downwardly between the first central portion 36 and a respective one of the first lateral side 32 and the second lateral side 34. The bottom side 30 has a second central portion 40 extending between a pair of second curved portions 42. Each of the second curved portions 42 curves upwardly between the second central portion 40 and a respective one of the first lateral side 32 and the second lateral side 34. The male electrical plug 12 has a plurality of contacts 44 each extending away from the front end 22 of the male electrical plug 12. Additionally, the plurality of contacts 44 is centrally positioned between the first lateral side 32 and the second lateral side 34. The front end 22 of the male electrical plug 12 inhibits the male electrical plug 12 from tilting laterally when the contacts 44 are plugged into the female electrical outlet 16. In this way the contacts 44 are inhibited from being bent or broken.

Figure 8:
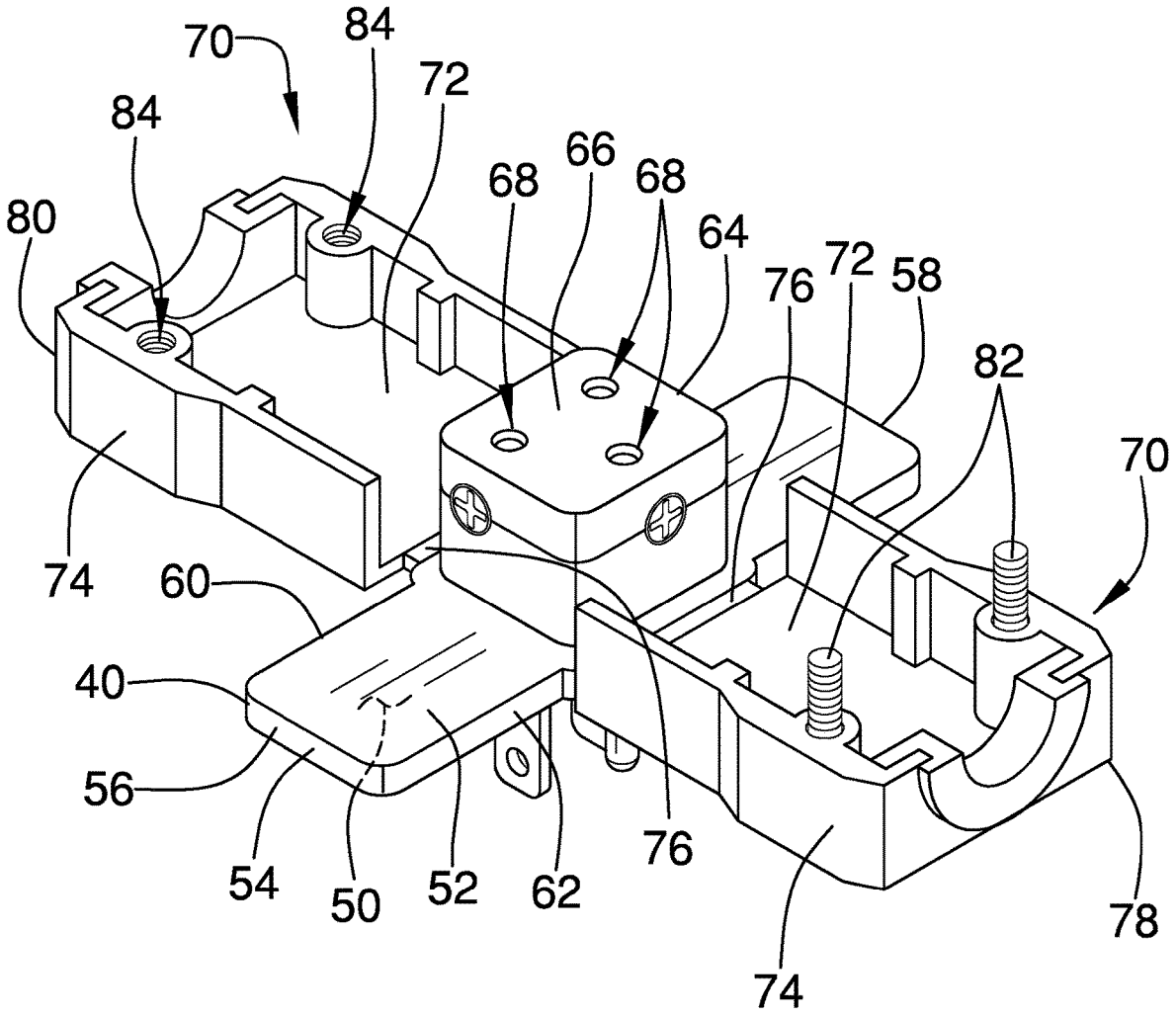
FIG. 8 is a perspective view of an alternative embodiment of the disclosure.
Figure 9:
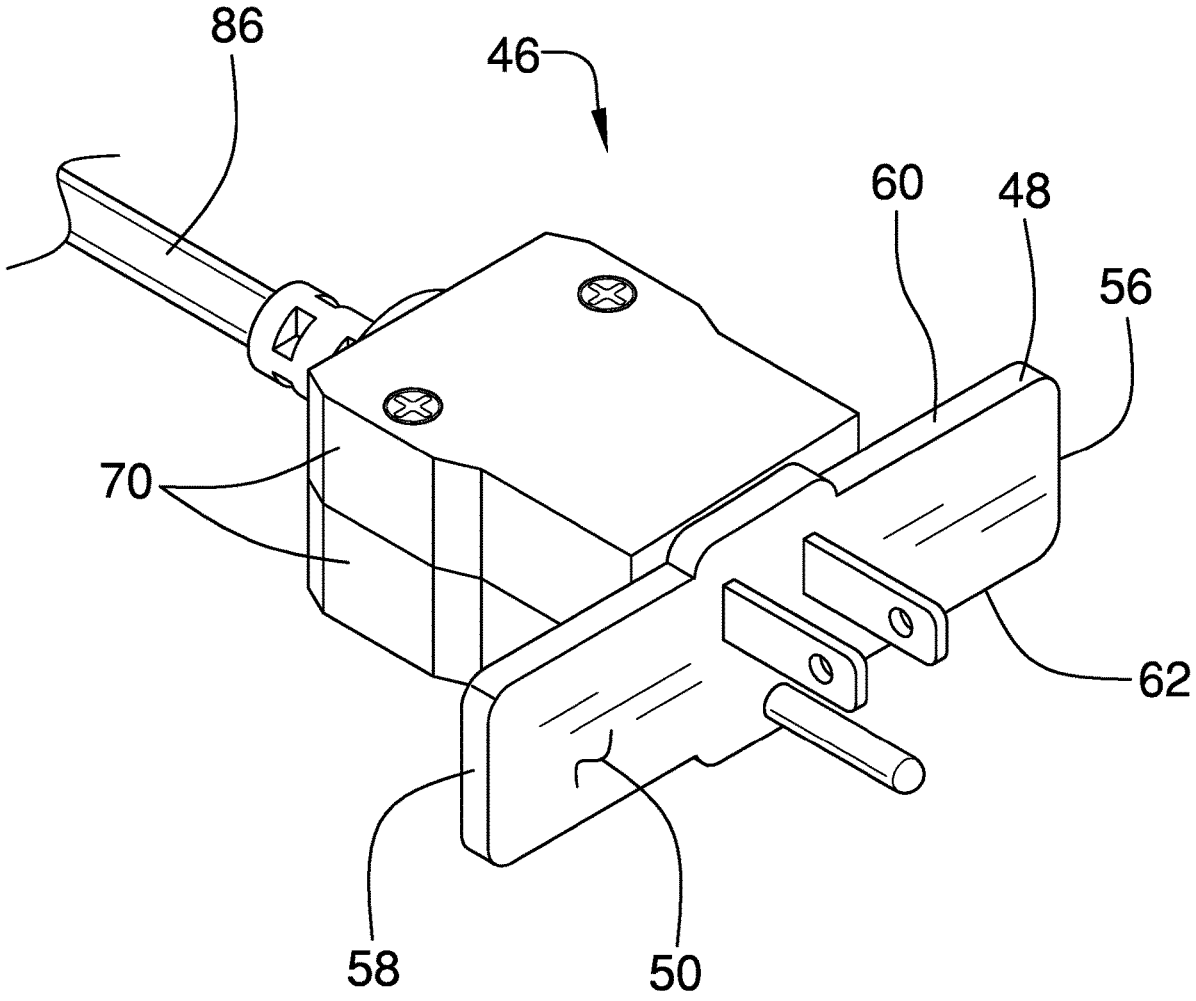
FIG. 9 is a front perspective view of an alternative embodiment of the disclosure.

In an alternative embodiment 46 as is shown in FIGS. 8 and 9, a panel 48 is provided which has a front surface 50, a back surface 52 and a perimeter edge 54 extending between the front surface 50 and the back surface 52. The perimeter edge 54 has a first lateral side 56, a second lateral side 58, a top side 60 and a bottom side 62, and the panel 48 is elongate between the first lateral side 56 and the second lateral side 58 of the perimeter edge 54. A housing 64 is coupled to and extends away from the back surface 52 of the panel 48 and the housing 64 has a distal end 66 with respect to the back surface 52. The distal end 66 has a plurality of holes 68 each extending into an interior of the housing 64 to insertably receive a respective one of a plurality of conductors.

Continuing in the alternative embodiment 46, the male electrical plug 12 includes a pair of enclosures 70 which each has a front wall 72 and an exterior wall 74 extending away from the front wall 72. The front wall 72 of each of the enclosures 70 has a coupled edge 76 and the coupled edge 76 of each of the enclosures 70 is hingedly coupled to a respective one of the top side 60 and the bottom side 62 of the perimeter edge 54 of the panel 48. Each of the enclosures 70 is positionable in a closed position having the exterior wall 74 of each of the enclosures 70 abutting each other such that each of the enclosures 70 encloses the housing 64. Additionally, each of the enclosures 70 is centrally positioned between the first lateral side 56 and the second lateral side 58 of the perimeter edge 54 of the panel 48.

The pair of enclosures 70 includes a first enclosure 78 and a second enclosure 80. The first enclosure 78 has a pair of fasteners 82 integrated into the first enclosure 78 and the second enclosure 80 has a pair of wells 84 each integrated into the second enclosure 80. Each of the fasteners 82 engages a respective one of the wells 84 when the first enclosure 78 and the second enclosure 80 are positioned in the closed position. The alternative embodiment 46 can be retrofitted onto an existing power cord 86 for replacing a damaged male electrical plug 12 on the existing power cord 86. Additionally, the panel 48 inhibits the alternative embodiment 46 from tipping sideways in the female electrical outlet 16.

In use, the contacts 44 are plugged into the female electrical outlet 16. Each of the wings 18 abuts the wall plate 20 of the female electrical outlet 16. Each of the wings 18 inhibits the male electrical plug 12 from tipping sideways in the female electrical outlet 16 when the power cord 14 is pulled from being tripped upon, for example. In this way the contacts 44 on the male electrical plug 12 are inhibited from being bent or broken as a result of the male electrical plug 12 being pulled sideways in the female electrical outlet 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An electrical cord plug assembly for inhibiting an electrical plug from being bent sideways in an electrical outlet, said assembly comprising:

a male electrical plug being electrically coupled to an electrical cord wherein said male electrical plug is configured to be plugged into a female electrical outlet, said male electrical plug having a pair of wings each extending laterally away from said male electrical plug wherein each of said wings is configured to abut a wall plate of the female electrical plug when said male electrical plug is plugged into the female electrical plug, each of said wings extending in opposite directions from each other on said male electrical plug wherein said wings are configured to inhibit said male electrical plug from being bent sideways in the female electrical plug;

wherein said male electrical plug has a front end, a back end and an outer wall extending between said front end and said back end, said outer wall having a top side, a bottom side a first lateral side and a second lateral side, said male electrical plug being elongated between said first lateral side and said second lateral side such that each of said first lateral side and said second lateral side defines an end of a respective one of said wings; and wherein said top side has a first central portion extending between a pair of first curved portions, each of said first curved portions curving downwardly between said first central portion and a respective one of said first lateral side and said second lateral side.

2. The assembly according to claim 1, wherein said bottom side has a second central portion extending between a pair of second curved portions, each of said second curved portions curving upwardly between said second central portion and a respective one of said first lateral side and said second lateral side.

3. The assembly according to claim 1, wherein said male electrical plug has a plurality of contacts each extending away from said front end of said male electrical plug, said plurality of contacts being centrally positioned between said first lateral side and said second lateral side, said front side of said male electrical plug inhibiting said male electrical plug from tilting laterally when said contacts are plugged into the female electrical outlet thereby inhibiting said contact from being bent or broken.

4. An electrical cord plug assembly for inhibiting an electrical plug from being bent sideways in an electrical outlet, said assembly comprising:

a male electrical plug being electrically coupled to an electrical cord wherein said male electrical plug is configured to be plugged into a female electrical outlet, said male electrical plug having a pair of wings each extending laterally away from said male electrical plug wherein each of said wings is configured to abut a wall plate of the female electrical plug when said male electrical plug is plugged into the female electrical plug, each of said wings extending in opposite directions from each other on said male electrical plug wherein said wings are configured to inhibit said male electrical plug from being bent sideways in the female electrical plug, said male electrical plug having a front end, a back end and an outer wall extending between said front end and said back end, said outer wall having a top side, a bottom side, a first lateral side and a second lateral side, said male electrical plug being elongated between said first lateral side and said second lateral side such that each of said first lateral side and said second lateral side defines an end of a respective one of said wings, said top side having a first central portion extending between pair of first curved portions, each of said first curved portions curving downwardly between said first central portion and a respective one of said first lateral side and said second lateral side, said bottom side having a second central portion extending between a pair of second curved portions, each of said second curved portions curving upwardly between said second central portion and a respective one of said first lateral side and said second lateral side, said male electrical plug having a plurality of contacts each extending away from said front end of said male electrical plug, said plurality of contacts being centrally positioned between said first lateral side and said second lateral side, said front side of said male electrical plug inhibiting said male electrical plug from tilting laterally when said contacts are plugged into the female electrical outlet thereby inhibiting said contact from being bent or broken.

5. The assembly according to claim 4, wherein said male electrical plug includes:

a panel having a front surface, a back surface and a perimeter edge extending between said front surface and said back surface, said perimeter edge having a first lateral side, a second lateral side, a top side and a bottom side, said panel being elongate between said first lateral side and said second lateral side; and a housing being coupled to and extending away from said back surface of said panel, said housing having a distal end with respect to said back surface, said distal end having a plurality of holes each extending into an interior of said housing wherein each of said holes is configured to insertably receive a respective one of a plurality of conductors.

6. The assembly according to claim 5, wherein said male electrical plug includes a pair of enclosures, each of said enclosures having a front wall and an exterior wall extending away from said front wall, said front wall of each of said enclosures having a coupled edge, said coupled edge of each of said enclosures being hingedly coupled to a respective one of said top side and said bottom side of said perimeter edge of said panel, each of said enclosures being positionable in a closed position having said exterior wall of each of said enclosures abutting each other such that each of said enclosures encloses said housing, each of said enclosures being centrally positioned between said first lateral side and said second lateral side of said perimeter edge of said panel.

7. The assembly according to claim 6, wherein said pair of enclosures includes a first enclosure and a second enclosure, said first enclosure having a pair of fasteners being integrated into said first enclosure, said second enclosure having a pair of wells each being integrated into said second enclosure, each of said fasteners engaging a respective one of said wells when said first enclosure and said second enclosure are positioned in said closed position.

* * * * *